United States Patent [19]

Tanaka et al.

[11] 3,965,962

[45] June 29, 1976

[54] PROCESS FOR PRODUCING DUCTILE IRON CASTING

[75] Inventors: Toshiaki Tanaka, Kure; Shunsuke Yamaguchi; Kazuharu Simowaki, both of Hiroshima, all of Japan

[73] Assignee: Toyo Kogyo Co., Ltd., Hiroshima, Japan

[22] Filed: Feb. 21, 1975

[21] Appl. No.: 551,883

Related U.S. Application Data

[63] Continuation of Ser. No. 236,830, March 22, 1972, abandoned, which is a continuation-in-part of Ser. No. 827,582, May 26, 1969, abandoned.

[30] Foreign Application Priority Data

May 25, 1968 Japan ..... 43-35640

[52] U.S. Cl. ..... 164/55; 75/130 R; 148/35

[51] Int. Cl.[2] ..... B22D 27/20

[58] Field of Search ..... 164/14, 33, 53, 72, 164/113, 138, 348, 55; 148/3, 35; 75/130

[56] References Cited

UNITED STATES PATENTS

| | | | |
|---|---|---|---|
| 1,597,861 | 8/1926 | Meloche | 164/33 X |
| 2,324,322 | 7/1943 | Reese et al. | 148/3 |
| 2,352,408 | 6/1944 | Reece et al. | 148/3 |
| 2,749,587 | 6/1956 | Richards et al. | 164/72 |
| 2,867,554 | 1/1959 | Wilson et al. | 148/3 |
| 3,005,736 | 10/1961 | Peras | 148/3 X |
| 3,415,307 | 12/1968 | Schuh et al. | 164/138 X |
| 3,565,609 | 2/1971 | Saeki et al. | 148/35 X |

FOREIGN PATENTS OR APPLICATIONS

| | | | |
|---|---|---|---|
| 255,994 | 11/1962 | Australia | 164/72 |
| 1,951,948 | 5/1970 | Germany | 164/348 |

*Primary Examiner*—Ronald J. Shore
*Assistant Examiner*—Gus T. Hampilos
*Attorney, Agent, or Firm*—Sughrue, Rothwell, Mion, Zinn & Macpeak

[57] ABSTRACT

A process for producing sound ductile cast iron crank shafts without the use of chillers and also with no, or substantially no, blind risers at the upper ends of the cast crank shafts in the bottom gating-type of vertical pouring system. The process comprises pouring a specifically treated ductile cast iron melt having a high outward expansion property during its eutectic solidification into a specific metal mold assembly having a high rigidity and a high thermal conductivity.

8 Claims, 8 Drawing Figures

FIG. 1
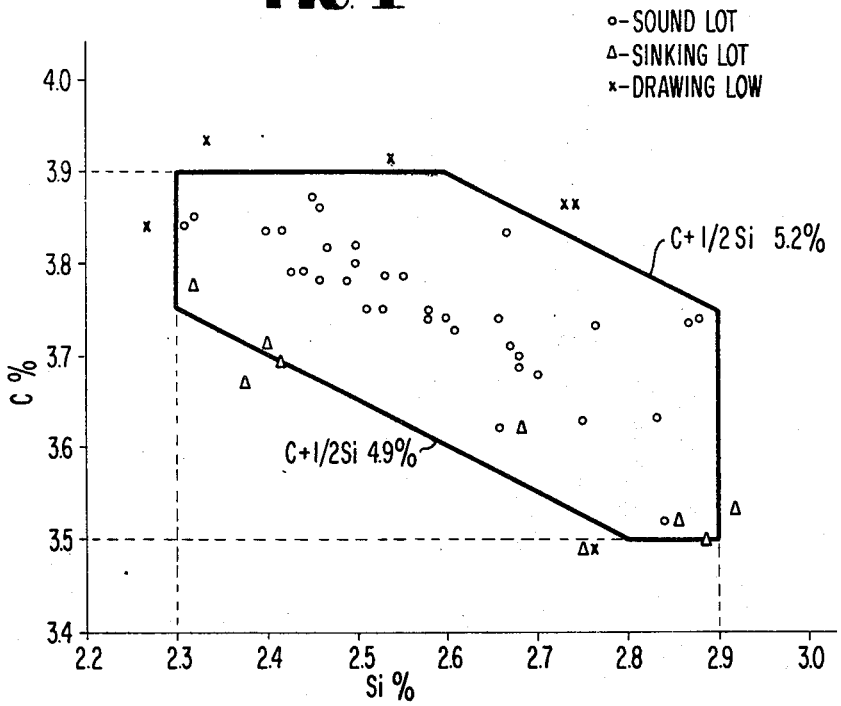
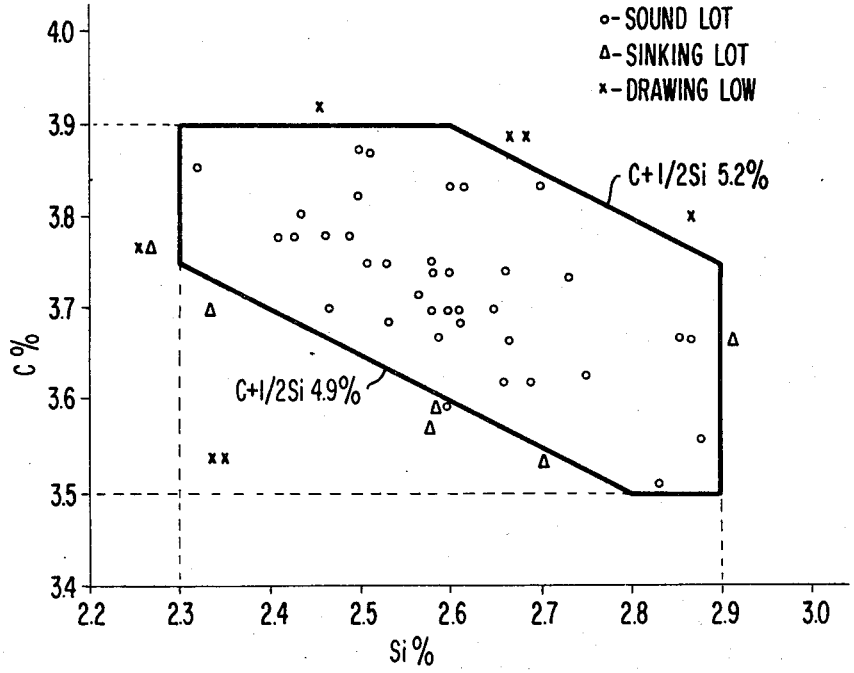
FIG. 6

PROCESS FOR PRODUCING DUCTILE IRON CASTING

CROSS REFERENCE TO RELATED APPLICATION

This is a continuation of application Ser. No. 236,830, filed Mar. 22, 1972, now abandoned.

This application is a continuation-in-part of Ser. No. 827,582 filed May 26, 1969, now abandoned.

BACKGROUND OF THE INVENTION

1. Field of the Invention

This invention concerns improvements in and relating to a process for producing sound ductile cast iron crank shafts with the use of no, or substantially no, blind riser portions at the upper end of the crank shaft portions in the bottom gating-type of vertical pouring system.

In this specification the term "substantially no riser" includes an extension of the casting as the machinery allowance to accommodate a sinking in the casting.

2. Prior Art

As is well known, ductile cast iron is widely employed in various industrial areas because of its excellent physical properties. However, its use is apt to result in various types of casting defects as compared with castings formed from flake graphite cast iron, especially in the formation of shrinkage cavities. Therefore, it is conventional practice to attach large risers or shrinkers to the casting proper and, moreover, to apply an exothermic sleeve onto the riser or to provide a chiller at casting parts exhibiting the shrinkage defects, in order to eliminate such shrinkage defects. As a result of such conventional expedients, the yield of ductile iron casting (casting weight/pouring weight) is much reduced, to as little as 50% or less, and even to 40% or less in some cases.

The reason why ductile cast iron possesses greater shrinkage characteristics as compared with flake cast iron is considered to be that growth of the external solidified layer is slower and that solidification of the poured metal starts, not only from the external surface, but also from the internal nuclei, which are formed during the progress of the metal solidification, and that the solidification expansion of ductile cast iron is considerably large. In other words, since the external solidified layer (shell layer) of ductile cast iron is still thin and weak when the larger volume of internal liquid metal begins to solidify, solidification expansion of the internal liquid metal results, accompanied by enlargement of the casting as well as any internal voids and possibly resulting in the formation of fresh cavities. On the contrary, since the shell layer (external solidified layer) of flake cast iron is thick and strong at the time when the internal liquid metal begins to solidify, isolated eutectic cells can displace liquid metal into any initially-formed shrinkage voids.

Further, since the thickness of various sections of the castings varies widely and the thin sections solidify before the heavy sections solidify, the shrinkage occurs because of insufficient feeding of melt into the shrinking section. This is especially the case with ductile cast iron. Extremely small sized articles or uniform thin-walled articles can be cast soundly with no, or substantially no, risers, but this is the rare case. The riser is generally considered to be essential to the production of medium or large sized sound ductile iron castings. More particularly, the riser is considered to be essential to the production of ductile cast iron crank shafts.

Therefore, it is usual practice to attach blind risers at the upper ends of the cast crank shafts larger than those employed with flake cast iron, to provide a chiller at the thick-walled zone to promote uniform cooling throughout the casting and/or to apply an exothermic sleeve to the neck of the riser to increase the feeding effect for the production of sound ductile cast iron crank shafts.

It is known that the formation of shrinkage cavities is reduced by pouring molten metal with low solidification expansion properties into a rigid mold and to cool the molten metal at a uniform rate, but a technique for the production of sound ductile cast iron crank shafts with the use of no, or substantially no, blind risers at the upper ends of the cast crank shafts has yet to be established.

3. Objects of the Invention

Therefore, an object of this invention is to produce sound ductile cast iron crank shafts without chillers and also with the use of no, or substantially no, blind risers at the upper ends of the case crank shafts in the bottom gating-type vertical pouring system, the production of which crank shafts would otherwise require the use of ordinary risers and chillers.

Another object of this invention is to produce ductile cast iron crank shafts in high yield and accordingly with low cost.

Other objects of the invention will be obvious to those skilled in the art as the description of this invention proceeds.

SUMMARY OF THE INVENTION

This invention provides a process for producing sound ductile cast iron crank shafts exhibiting the nodular graphite dispersed structure. The process comprises pouring a specifically treated ductile cast iron melt into a specific metal mold assembly in the bottom gating-type vertical pouring system. Said treated ductile cast iron melt is prepared by the steps of adjusting the composition of a cast iron melt to contain, after subsequent graphite spheroidizing treatment and adding a silicon inoculant, carbon in an amount of from 3.5 to 3.9%, silicon in an amount of from 2.3 to 2.9%, and carbon plus ½ silicon content within the range of 4.9 to 5.2%, subjecting the melt to the graphite spheroidizing treatment and adding the silicon inoculant in an amount of up to 0.6% of melt. The melt mold assembly comprises a set of metal dies having no, or substantially no, blind riser portion at the upper ends of the crank shaft portion and fixedly assembled to withstand a force which is greater than the outward expansion force of said poured melt developed upon its eutectic solidification. Each of said metal dies is lined with a thin sand layer having a thickness of more than 3 mm in order to utilize the high cooling capacity of the metal dies, but at the same time absorb the expansion and prevent chill formation in the resulting casting.

Several advantages obtained by this process are as follows:

1. Sound ductile cast iron crank shafts can be obtained with the use of a mold having no, or substantially no, blind riser portions at the upper ends of the crank shaft portions.

2. The yield of casting is advantageously increased by the reduction of unnecessary pouring weight.

3. Production of the mold is simplified due to the lack of any necessity for chillers and exothermic sleeves, resulting in easier mass-production of the mold.

4. The handling of the mold becomes much easier due to its compact size.

5. Time required for cutting off the risers and removing the fins is much reduced.

6. Mechanical properties are improved, and heat treatment for tempering or homogenizing is not required for some cast iron crank shafts.

7. Capacity of the cupola or other melting furnace is more fully utilized.

8. The prime cost for the casting is much reduced with the aforesaid merits.

It must also be noted that it has heretofore not been possible to produce cast crank shafts from a mold which does not have blind riser portions at the upper ends of the crank shaft portions. In other words, the problem is to find a particular melt which, with a particular mold, fulfills the objects set out heretofore. More particularly, in the casting art, it is very important which melt is cast in which mold. There are, of course, innumerable types of melts and molds.

Heretofore, it has been believed that a melt having a small expansion upon eutectic solidification should be used in order to fabricate a ductile cast iron crank shaft. The present invention reveals that to the contrary, a melt having a large expansion upon eutectic solidification is necessary.

DESCRIPTION OF THE DRAWINGS

A more detailed embodiment of this invention will be described hereinafter with the aid of the accompanying drawings.

FIG. 1 shows the relation between the composition and soundness of the casting prepared according to Example 1.

FIG. 6 shows the relation between the composition and soundness of the casting prepared according to Example 2.

DETAILED DESCRIPTION OF THE INVENTION

Figure 2:
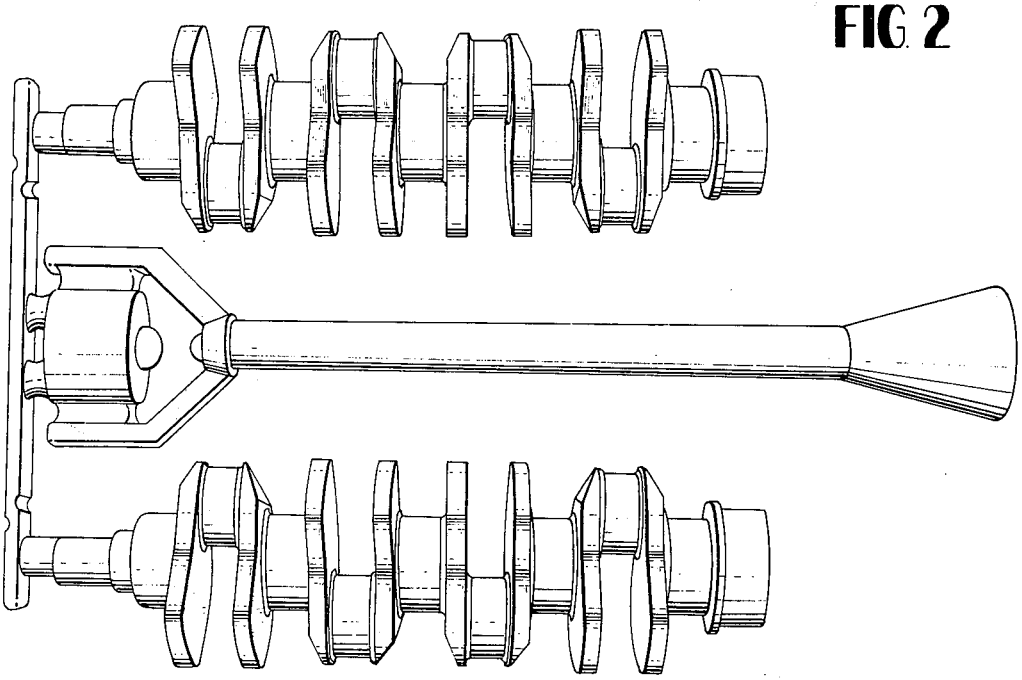
FIG. 2 illustrates cast crank shafts produced as in Example 1.

One aspect of this invention is far different from that of the aforesaid conventional process. That is to say, ductile cast iron melts, treated so as to possess high "solidification expansion" properties, are poured into a rigid mold having a high thermal conductivity or cooling capacity, thereby to form first a solid layer, or skin as equally thick as that formed by flake cast iron, and then cause inner solidification; and at the same time, the cavities or voids formed in the casting during the solidification are filled with expanding liquid metal.

As metal molds are most rigid of all molds, they are assumed to be most favorable for the aforesaid object, if coated with some of the mold wash; but metal molds often cause "chilling", or precipitation of the primary cementite at the casting surface or the thin walled part, preventing the full contribution of the expanding liquid metal during the eutectic solidification. Therefore, this process makes use of a metal mold having no, or substantially no, blind riser portions and lined with a thin sand layer, thereby utilizing the high thermal conductivity of the mold and, at the same time, preventing the chill formation.

A metal die assembly lined with a sand shell layer is designated as a "metal-backed shell mold" and is produced by injecting either a mixture composed of silica sand and thermosetting resin (generally the novoiak type phenol-formaldehyde resin), or resin-coated sand, into an aperture between a heated pattern and a die, thereby adhering thermally the set sand-resin to the inner face of the metal die. This is known as a modification of the "shell molding process" or "Croning process".

The metal-backed shell mold is usually mass-produced. The metal die is attacked by thermal shocks during repeated use and therefore the wall thickness of the metal die is determined in consideration of durability and ease of handling. The metal die employed in the process of this invention may preferably have a wall thickness of more than 20 mm, but may have less than 20 mm thickness, so long as deformation does not take place.

On the other hand, the thickness of the lining shell layer is more than 3 mm in consideration of the shape and size of the casting to be produced. The thickness ranges preferably from 5 to 10 mm, but may exceed 10 mm, if necessary.

A 3–15 mm thick layer of selfhardening sand, cement sand, $CO_2$ process sand or Ashland process sand, etc., are similar lining layers as the shell molding sand and may be employed with equally advantageous effects.

If the casting requires a core, its structure is required to be similar to the mold, and is preferably produced by coating a metal core surface with the shell molding sand layer in a similar manner as the mold.

The obtained shell mold segments backed up by the metal dies are mutually assembled fixedly with such force that most of the expanding liquids fill the voids during the eutectic solidification of the melt, but do not expand outwards to deform or disassemble the mold assembly. The force required for fixedly assembling the molding segments is considerably high and changes in accordance with the shape, size and weight of the casting to be produced.

One of the conditions to produce sound ductile cast iron crank shafts is tight assembly of the metal mold segment having no, or substantially no, blind riser portions at the upper ends of the crank shaft portions and lined with the shell layer.

Another condition is that the ductile cast iron melt poured into said mold assembly should be inoculated by adding up to 0.6% of Si and that it should contain C, 3.5–3.9%, Si, 2.3–2.9%, and C + ½ Si, 4.9–5.2%, just before it is poured into the mold assembly. These optimum ranges of C and Si were discovered only after extensive empirical study.

If the carbon and silicon contents range below 3.5% and 2.3%, respectively, the available graphite is not fully formed to contribute the solidification expansion of the ductile cast iron melts, thus causing the shrinkage cavity, whereas if the carbon and silicon contents exceed 3.9% and 2.9%, respectively, the dross and shrinkage cavity are formed in the crank shaft casting. It is clear that the effect of silicon on this process is larger than that of the standard carbon equivalent (C.E. = C + ⅓ Si), that C + ½ Si is more available, and it is also clear that if the (C + ½ Si) content falls below 4.9% the shrinkage cavity is formed, whereas if the C + ½ Si content exceeds 5.2% the shrinkage cavity and dross are readily formed. Therefore, the contents of C, Si and C + ½ Si must be within the ranges of 3.5–3.9%, 2.3–2.9%, and 4.9–5.2%, respectively.

Although the higher carbon and silicon contents have been considered to cause the dross formation in the casting according to the shape coefficient (surface area/volume), the most favorable casting results are obtained in this process when the C + ½ Si content is 5.0–5.1%.

Therefore one of the important steps of this invention is to inoculate the ductile cast iron melt with up to 0.6% silicon, to generate many fine graphite nodules during the eutectic solidification by means of the shell layer lined metal mold having high thermal conductivity, to increase the number of graphite nodules considered as the eutectic cells, and to increase the expandng force of the melt.

Amounts of silicon inoculated into the ductile cast iron melts are usually great as compared with the silicon amounts employed in the conventional casting process of ductile cast iron crank shafts for preventing shrinkage cavity formation.

The silicon inoculation according to this invention is applied to the ductile cast iron melts with such objects, and is therefore what is intended as not a mere composition adjustment without the inoculation effect.

As the result of empirical studies on ductile cast iron melts from the cupola and the electric furnace, effective inoculating amounts of ferrosilicon, metallic silicon and calcium silicon were 0.2–0.4%, 0.3–0.6%, and up to 0.2%, respectively. (These amounts are converted into that of pure silicon.) If the silicon inoculating amounts exceed 0.6%, unfavorable shrinkage cavities are formed. Thus, it is essential in this process to increase the silicon inoculating amounts as much as possible within the stated range and to pour the inoculated melt into the mold as soon as possible before the fading of the inoculation effect.

In addition to that, the pouring temperature is preferably kept below 1400°C to minimize liquid shrinkage and to increase the number of eutectic graphite nodules.

Therefore, the preferable pouring operation, in consideration of the inoculation effect and pouring temperature, comprises the first step of graphite spheroidizing the cast iron melts at a temperature of about 1500°C after preliminarily adjusted carbon and silicon compositions, the second step of inoculating the treated melts in 300–500 kg/ladle, and the final step of pouring the inoculated melts at a temperature of 1400°–1350°C into the mold within 10 minutes, preferably within 6 minutes, after the inoculation. It will be noted that the aforesaid pouring procedures can be modified in accordance with various conditions well known in the art; and therefore, the pouring procedure is not restricted merely to the specifically exemplified one.

EXAMPLE 1

Figure 3:
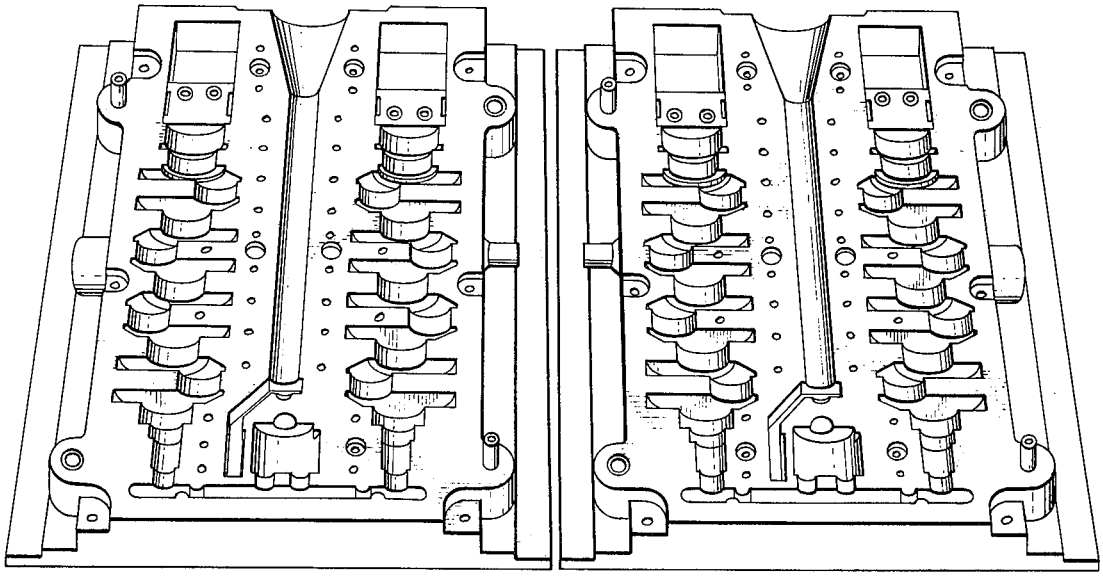
FIG. 3 illustrates a pair of metal backed shell molds utilized to produce the crank shafts of Example 1.

A pair of mold halves produced by lining a 5 mm thick sand-resin shell layer on the inner face of an at least 20 mm thick metal die having a bottom gating system of vertical pouring system without blind riser portions at the upper ends of the crank shaft portions, as shown in FIG. 3, for crank shafts used for a 1000 cc automobile engine were assembled fixedly into a mold. Prior to the pouring of metal, the temperature of each mold assembly was controlled to room temperature ~300°C, respectively.

A mixture composed of 3 parts by weight of steel scrap and 1 part by weight of returned stock was charged into a high frequency induction furnace together with small amounts of a carburizing agent, and melted therein. Then, the composition of the melt was adjusted in the furnace by adding desired amounts of Cu and Fe-Si. The melts were further treated to form nodular graphite by adding Fe-Si-Mg and rare earth metal containing Ce by the phosphorizer. The melts subjected to the graphite spheroidizing treatment were finally inoculated with Fe-Si 0.6% (0.3% as pure Si). The obtained melts were poured into the molds within 4 minutes after the inoculation at a pouring temperature of 1400°–1350°C. Fifty lots (1 lot corresponds to 16 crank shafts obtained by 8 molds) were tested as to the soundness of the cast products. In these 50 lots, the C, Si and C + ½ Si composition of the melts was controlled by the addition of a carburizing agent and Fe-Si in the furnace.

The test results are shown in Table 1 and FIG. 1, and classified into the "sound" group, the "sinking" group, and "drawing" group. Where any sinking or drawing casting was contained in a charge, all the castings in that lot were classified as sinking or drawing castings. In FIG. 1, O, Δ, and X represent the sound, sinking and drawing lot, respectively. It is apparent from FIG. 1 that the melts containing C 3.5–3.9%, Si 2.3–2.9% and C + ½ Si 4.9–5.2% cause a few sinking castings having the depth of sink less than 2 mm (such sink depth being tolerable and subject to surface machining) and that the melts containing C, 3.5–3.9%, Si, 2.4–2.8%, and C + ½ Si, 5.0–5.2% result in fully sound castings. These sound castings and those having only slight sinking turned out to have no internal defects as shown by ultrasonic ray scanning inspection. The soundness of these castings was ascertained not to be effected by temperature elevation of repeatedly used molds.

TABLE 1

| Composition of Cast Product (%) | | External Appearance of Product | |
|---|---|---|---|
| C | 3.49–3.93 | "Sound" castings | 34 lots |
| Si | 2.27–2.92 | "Sinking" castings | |
| Mn | 0.29–0.38 | Less than 1 mm sink depth | 2 lots |
| P | 0.014–0.027 | 1–2 mm sink depth | 6 lots |
| S | 0.016–0.028 | More than 2 mm sink depth | 2 lots |
| Mg | 0.036–0.051 | "Drawing" castings | 6 lots |
| Cu | 0.36–0.65 | | |

Figure 5:
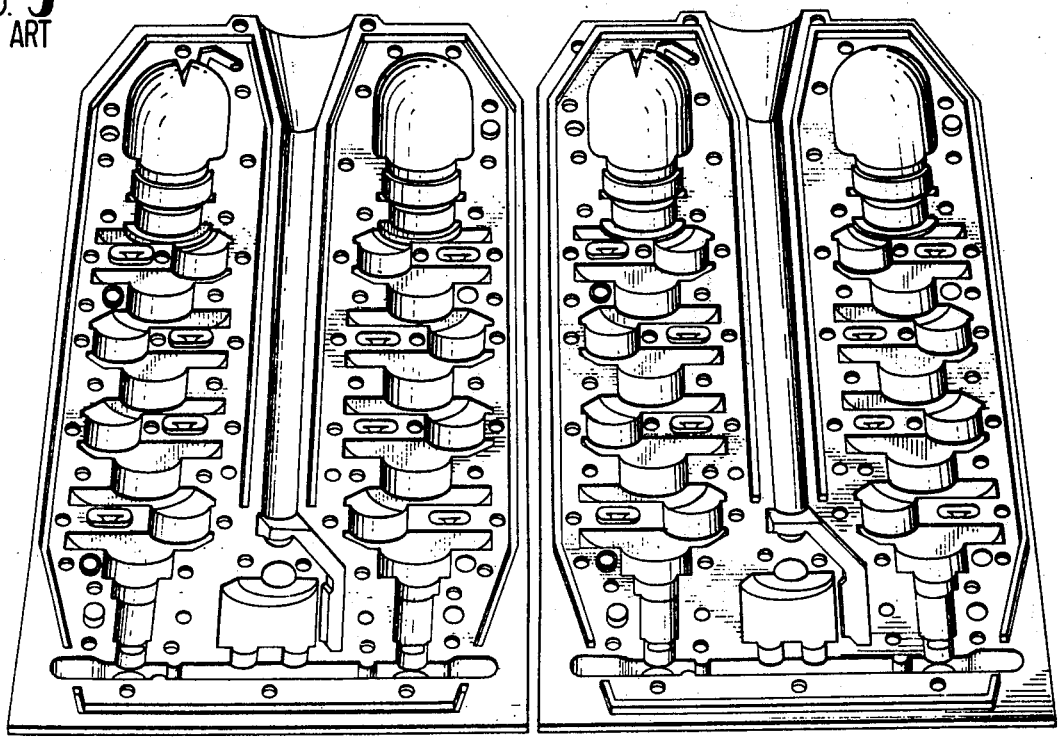
FIG. 5 PRIOR ART
FIG. 5 illustrates a pair of conventional shell molds utilized to produce the crank shafts of FIG. 4.

Table 2 illustrates the yield of cast crank shafts produced according to this invention as compared with the yield produced by such conventional practice as pouring cast iron melts containing C, 3.0–4.0% and Si, 2.0–3.5% into a shell mold backed up by steel shots as shown in FIG. 5.

TABLE 2

| | Pouring Weight | Casting Weight | Yield |
|---|---|---|---|
| Cast Product of this invention (FIG. 2) | 17.9 Kg | 13.7 Kg | 76.5% |
| Conventional Cast Product | 24.0 Kg | 13.7 Kg | 57.1% |

TABLE 2-continued

Figure 4:
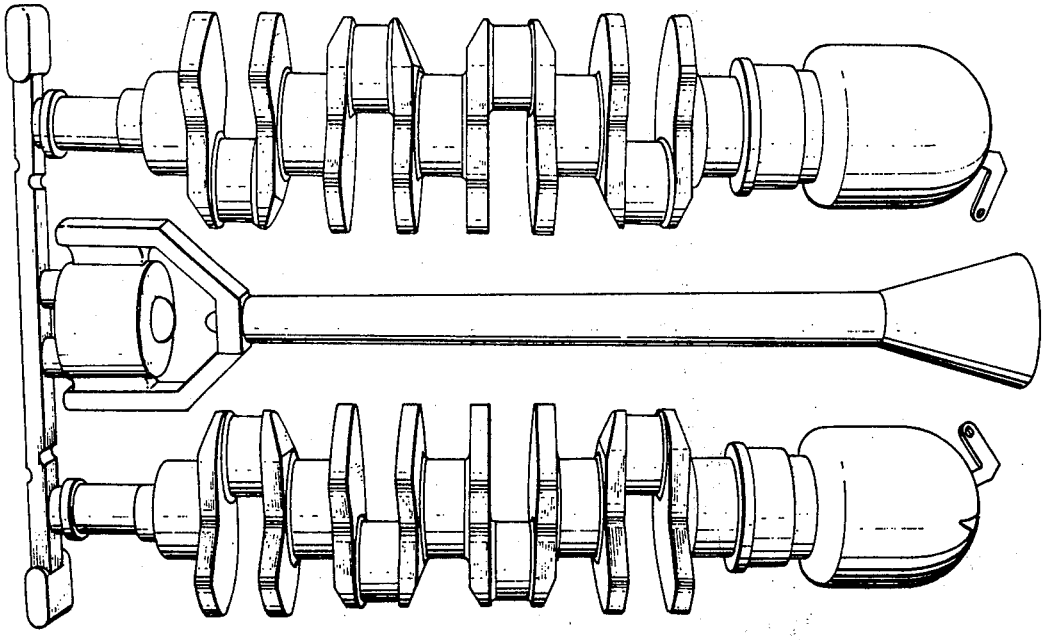
FIG. 4 PRIOR ART
FIG. 4 illustrates crank shafts comparable to those in FIG. 2, produced according to conventional practice.

| | Pouring Weight | Casting Weight | Yield |
|---|---|---|---|
| (FIG. 4) | | | |

EXAMPLE 2

A pair of mold halves produced by lining a 5 mm thick sand-resin shell layer on the inner face of a 30 mm thick metal die having a bottom gating-type of a vertical pouring system without blind riser portions at the upper ends of the crank shaft portions, for crank shafts used for a 2000 cc automobile engine, were assembled fixedly into a mold. These molds were similarly controlled to various temperatures as in Example 1.

A mixture composed of 1 part by weight of steel scrap and 1 part by weight of returned stock was charged into a cupola together with small amounts of Fe-Si and melted therein.

Then the melts were adjusted by adding Cu, subjected to graphite spheroidizing treatment and inoculated by 0.4% of metallic Si. The resultant melts were poured into the molds at 1400–1350°C within 4 minutes after the inoculation. Fifty lots of the melts (1 lot corresponds to 12 crank shafts obtained by 6 molds) were tested as to the soundness of the cast products. In these 50 lots, the C, Si and C + ½ Si compositions of the melts were controlled by adjustment of the cupola process variables and Fe-Si addition in the ladle before the spheroidizing treatment.

TABLE 3

| Composition of Cast Product (%) | | External Appearance of Product | |
|---|---|---|---|
| C | 3.51–3.92 | "Sound" castings | 37 lots |
| Si | 2.27–2.91 | "Sinking" castings | |
| Mn | 0.28–0.32 | Less than 1 mm sink depth | 4 lots |
| P | 0.015–0.028 | 1–2 mm sink depth | 1 lot |
| S | 0.014–0.025 | More than 2 mm sink depth | 1 lot |
| Mg | 0.041–0.053 | "Drawing" castings | 7 lots |
| Cu | 0.36–0.65 | | |

The test results are shown in Table 3 and FIG. 6, wherein the melts containing C, 3.5–3.9%, Si, 2.3–2.9%, and C + ½ Si, 4.9–5.2% produce sound cast crank shafts having no internal defects as checked by ultrasonic ray scanning inspection. A yield of the casting of this example and that produced according to conventional practice are compared in Table 4.

TABLE 4

Figure 7:
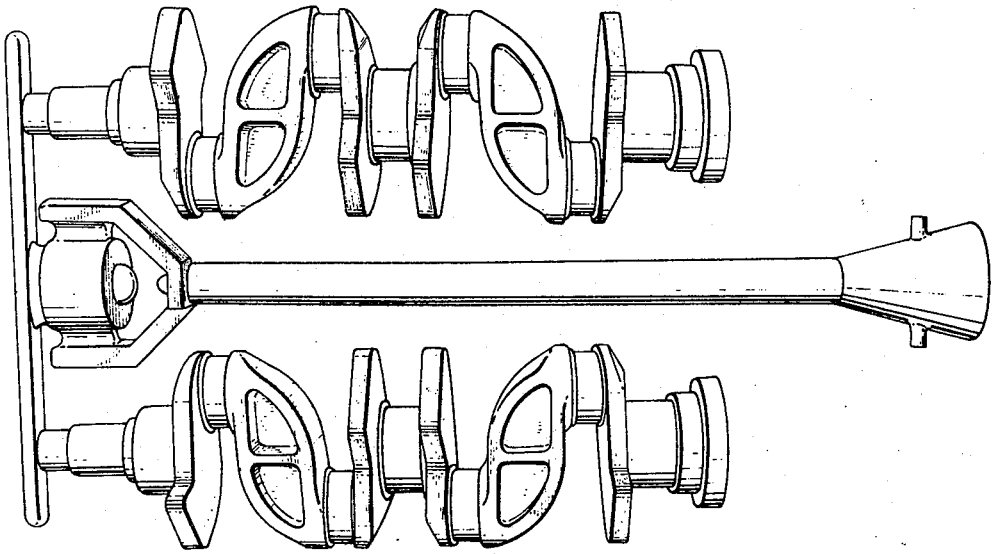
FIG. 7 illustrates cast crank shafts produced by Example 2.
Figure 8:
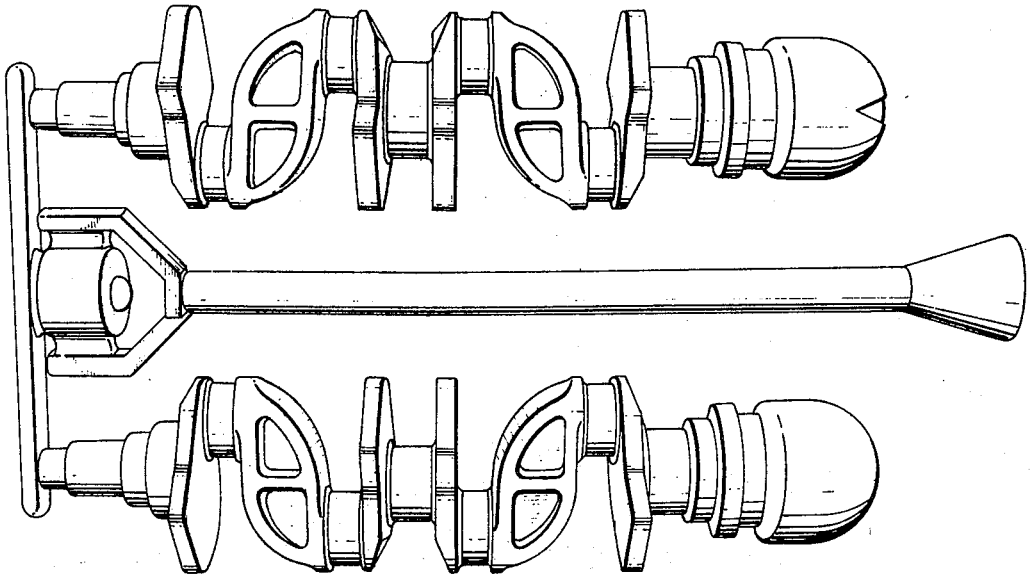
FIG. 8 PRIOR ART
FIG. 8 illustrates cast crank shafts comparable to those of FIG. 7, produced according to the conventional practice.

| | Pouring Weight | Casting Weight | Yield |
|---|---|---|---|
| Cast Product of this Invention (FIG. 7) | 23.9 Kg | 19.7 Kg | 82.4% |
| Conventional Cast Product (FIG. 8) | 31.1 Kg | 19.7 Kg | 63.3% |

In addition to Examples 1 and 2, ten types of crank shafts having various shapes and sizes, to be used for 360–2000 cc automobile engines, were produced soundly in the same manner as in the preceding examples with no, or substantially no, risers.

This invention is advantageously applied, not only to the production of ordinary ductile cast iron crank shafts containing C, Si, Mn, P, S and Mg and small amounts of incidental elements, but also to that of alloyed ductile Mn iron crank shafts containing up to 5% of alloying elements such as Cu, Mn, Mo, Ni or Cr.

On the other hand, exposing the metal die surface to the poured metal, or providing chillers at the desired location of the mold may be adopted to cause the local chill effect on the casting.

It will be understood by the skilled in this art that these examples are included within the scope of this invention without departing from the spirit of invention described herein before and claimed hereafter.

We claim:

1. In a process for producing a ductile case iron crankshaft exhibiting the nodular graphite dispersed structure which comprises preparing a treated ductile cast iron melt, preparing a mold assembly having a bottom gating and set as a vertical pouring system, and pouring said treated ductile case iron melt into said mold assembly to produce a rigid cast iron crankshaft without chill formation on the crankshaft, the improvement which comprises a. preparing said treating ductile case iron melt by subjecting a cast iron melt to graphite spheroidizing, and inoculating with up to 0.6% by weight of silicon to adjust the composition of the case iron melt to contain carbon in an amount of from 3.5 to 3.9%, and silicon in an amount from 2.3 to 2.9%, the combined carbon and ½ silicon content being within the range of 4.9 to 5.2%, and b. within 10 minutes after the silicon inoculation, introducing said treated ductile cast iron melt into said mold assembly comprising a set of metal dies free of blind riser portions at the upper end of the crank shaft portions and comprising means for fixedly assembling said metal dies so as to prevent the deformation of the mold assembly during its eutectic solidification, each of said metal dies being lined with a sand layer having a thickness of more than 3 mm.

2. The process of producing a ductile cast iron crankshaft as claimed in claim 1, wherein said crankshaft is produced by gravity of casting of said melt.

3. A process for producing a ductile cast iron crank shaft as claimed in claim 1 wherein said treated ductile cast iron melt contains one or more alloying elements selected from the group consisting of Cu, Mn, Mo, Ni, and Cr.

4. A process for producing a ductile cast iron crank shaft as claimed in claim 1 wherein said pouring of said treated ductile cast iron melt is carried out at a temperature of 1400° to 1350°C.

5. The process for producing a ductile cast iron crank shaft as claimed in claim 1 wherein each of said metal dies have a thickness of more than 20 mm.

6. The process for producing a ductile cast iron crank shaft as claimed in claim 1 wherein the carbon plus ½ silicon content is within the range of 5.0 to 5.1%.

7. The process for producing a ductile cast iron crank shaft as claimed in claim 1 wherein said sand thickness is in the range of 5 to 10 mm.

8. The process for producing a ductile cast iron crank shaft as claimed in claim 1 wherein said pouring is carried out within 6 minutes after adding the silicon inoculant.

* * * * *